United States Patent [19]

Friedman et al.

[11] Patent Number: 4,928,342

[45] Date of Patent: May 29, 1990

[54] MOP HOLDER

[75] Inventors: Herbert D. Friedman; Mark A. Friedman, both of Montreal, Canada

[73] Assignee: Cancot Industries Inc., Montreal, Canada

[21] Appl. No.: 312,470

[22] Filed: Feb. 21, 1989

[51] Int. Cl.[5] ..... A47L 13/24

[52] U.S. Cl. ..... 15/145; 15/147 R; 15/229.2

[58] Field of Search ..... 15/228, 229.1, 229.2, 15/147 R, 147 A, 145

[56] References Cited

U.S. PATENT DOCUMENTS

| | | | |
|---|---|---|---|
| 483,128 | 9/1892 | Beilmann et al. | 15/145 X |
| 505,579 | 9/1893 | Thurston | 15/145 X |
| 1,378,499 | 5/1921 | Toplitz | 15/147 R |
| 1,408,488 | 3/1922 | Toplitz | 15/229.2 X |
| 1,899,283 | 2/1933 | Lorang | 15/147 R X |
| 3,302,231 | 2/1967 | Petlett | 15/229.2 |
| 3,651,533 | 3/1972 | Bouras | 15/229.2 |
| 3,703,738 | 11/1972 | Moss et al. | 15/229.2 |
| 4,003,668 | 1/1977 | Kelly et al. | 15/145 X |
| 4,530,130 | 7/1985 | Moss | 15/229.2 |
| 4,642,837 | 2/1987 | Nichols et al. | 15/145 X |

*Primary Examiner*—Chris K. Moore

*Attorney, Agent, or Firm*—Samuel Meerkreebs

[57] ABSTRACT

A mop holder for a yarn-type mop head comprises a shank which is adapted for connection to a mop handle and an elongated member which has a threaded rod extending therefrom. The threaded rod includes an upper and a lower part. The lower part which is larger than the upper part is located intermediate the elongated member and this upper part. A nut is provided for engagement with the lower part of the threaded rod whereas the shank is adapted with an inner sleeve for screwable engagement thereof with the upper part of the threaded rod. The mop head comprises a grommet defined therein that is of larger transverse dimension than that of the lower part of the rod for being positioned therearound. Therefore the mop head is secured to the mop holder by way of the nut which is engaged in the rod while the shank ensures tightness of the nut.

9 Claims, 1 Drawing Sheet

MOP HOLDER

BACKGROUND OF THE INVENTION

1. Field of the Invention

The present invention relates to mop holders and, more particularly, to mop holders for replaceable yarn-type mop heads.

2. Description of the Prior Art

Most mop holders for replaceable mop heads presently use one of the two following general systems. In the guillotine-type system which is disclosed, for example, in U.S. Pat. Nos. 4,287,632 and 4,422,203, a hinged bar is closed against a retaining bar of the mop holder thereby fixing the mop head therewithin. It is common, using this system, that the hinged bar opens up under strain thereby releasing the mop head.

In the plier-type mechanism, which is disclosed, for instance, in U.S. Pat. Nos. 3,496,616 and 3,813,724, a first jaw, a spring-urged second jaw and a lever adapted to open the preceding jaws cooperate for holding a mop head within the confines thereof. This system, as well as the above described guillotine-type system, is costly.

SUMMARY OF THE INVENTION

It is therefore an aim of the present invention to provide a mop holder having a simple construction and, thus, lower cost.

It is a further aim of the present invention to provide a mop holder in which a mop head remains secured thereto even under heavy usage.

A construction in accordance with the present invention comprises a mop holder for a yarn-type mop head having a shank means which is adapted for connection to a mop handle. A mop head retaining means includes at least an elongated member which has a threaded rod extended therefrom. The shank means is adapted for screwable engagement thereof with the threaded rod. The mop head defines an opening which is of larger transverse dimension than that of the threaded rod for being positioned therearound. The mop head is thus secured to the mop holder by way of the shank means cooperating with the mop head retaining means.

In a further aspect of the present invention the threaded rod comprises first and second sections. The second section is located intermediate the elongated member and the first section. The second section is of larger transverse dimension than the first section, the second section substantially adjoining the first section. The first and second sections are also adapted for screwable engagement thereof respectively with the shank means and with a nut means. The mop head is therefore urged against the elongated member by way of the nut means whereas the shank means ensures tightness thereof.

In a still further aspect of the present invention, the mop retaining means also comprises a number of pointed tooth means extending from the elongated member in the same direction as the threaded rod into a middle section of the mop head. The tooth means puncture a lining means transversely extending from the middle section of the mop head, as tips of the tooth means are positioned in the mop head for providing further substantially lateral restraint of the mop head on the elongated member.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
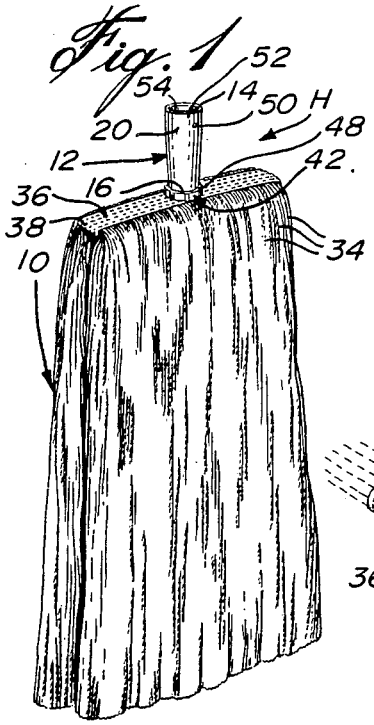
FIG. 1 is a perspective view of a mop holder in accordance with the present invention provided with a yarn-type mop head.
Figure 2:
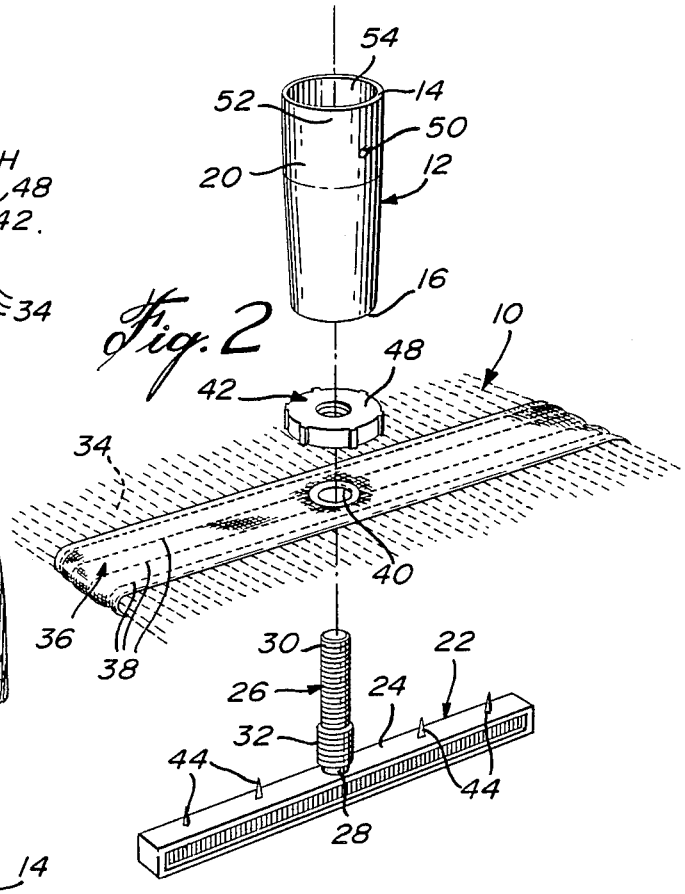
FIG. 2 is an exploded view showing how the mop head is mounted to the mop holder.

In FIG. 1, a mop holder H is shown with a disposable mop head 10 mounted thereto. The mop head 10 is made of yarn.

Figure 3:
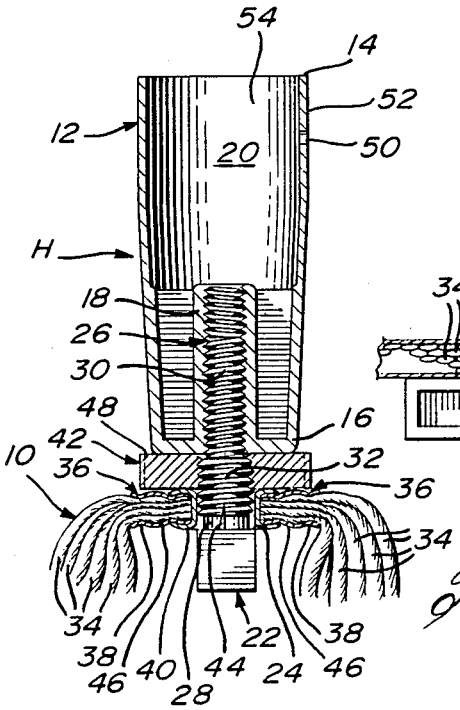
FIG. 3 is a side view shown partly in cross-section illustrating the mop head mounted to the mop holder.
Figure 4:
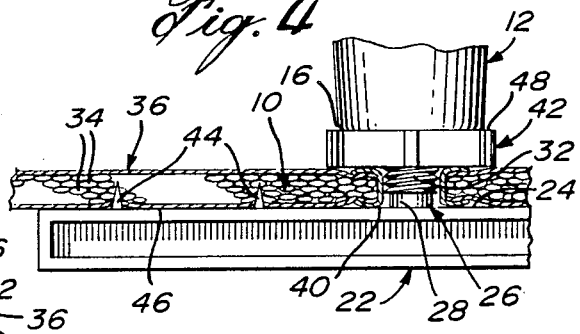
FIG. 4 is an elevation shown partly in cross-section illustrating the mop head mounted to the mop holder.

Now referring mainly to FIGS. 3 and 4, a plastic or metal shank 12 of circular cross-section has an open upper end 14 and a lower end 16. A threaded sleeve 18 is defined centrally and longitudinally in the shank 12 from the lower end 16 thereof. The upper hollow section 20 of the shank 12 is adapted for receiving a lower end of a standard mop handle, which is not shown.

A plastic elongated member 22 of rectangular cross-section includes an upper surface 24. A threaded rod 26, integral at a lower end 28 thereof to the elongated member 22, extends at right angles from the middle of the upper surface 24 of the member 22. The elongated member 22 and the threaded rod 26 can thus be manufactured from the same mold.

The rod 26 comprises first and second threaded sections 30 and 32 respectively. The first threaded section 30 is of smaller diameter than that of the second threaded section 32.

The mop head 10 comprises yarns 34 maintained in a unit by way of a lining 36 and of stitchings 38. The yarns 34 are maintained to the lining 36 substantially at their middle, as best seen in FIG. 1.

A brass grommet 40 is press-fitted into the lining 36 at the middle thereof. The grommet 40 is of larger diameter than that of the second threaded section 32 of the rod 26. The mop head 10 has a transverse dimension substantially equal to the longitudinal dimension of the elongated member 22 for overlying the elongated member 22 once the grommet 40 has been slidably positioned around the lower end 28 of the threaded rod 26. An oversized nut 42, made of hard plastic, is adapted for screwable engagement thereof with the second threaded section 32 of the rod 26. The longitudinal dimension of the second threaded section 32 is provided with respect to the thickness of the mop head 10 in order that the oversized nut 42 can be screwed onto the second threaded section 32 for exerting pressure on the grommet 40 and on a section of the lining 36 around the grommet 40 and underlying the oversized nut 42. The mop head 10 is thus secured to the mop holder H.

Additional lateral stability of the mop head 10 on the elongated member 22 is achieved by a number of pointed teeth 44 extending from the upper surface 24 of the elongated member 22. The pointed teeth 44 puncture through the lower section 46 of the lining 36 and partly through the yarns 34 of the mop head 10, as best seen in FIG. 4, for restraint thereof.

The shank 12 is screwed onto the first threaded section 30 of the rod 26 and abuts a top surface 48 of the nut 42 for enhancing tightness thereof.

The handle of the mop is longitudinally and laterally secured to the shank 12 by way of a nail or the like planted in the handle through an opening 50 defined in a wall 52 of the upper hollow section 20 of the shank 12.

It can be easily seen that the present invention offers a mop holder H having a simple construction and thus a low cost. Furthermore, the mop holder H is sturdy and the mop head 10 is well secured thereto thus ensuring efficiency under heavy usage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A mop holder for a yarn-type mop head comprises a shank including a tubular sidewall, a bottom wall at a lower end of said sidewall and a threaded sleeve extending substantially at right angles from said bottom wall inside said shank, at least an upper part of said sidewall being adapted for connection to a mop handle; an elongated member having a threaded rod extending generally at right angles therefrom and intermediate thereof wherein the elongated member defines a pair of shoulders on either side of the rod, said rod comprising first and second threaded parts, said second threaded part being located intermediate said elongated member and said first threaded part, said second threaded part being of larger diameter than said first threaded part, said mop head defining an opening of larger diameter than said second threaded part of said rod for being positioned therearound; and a mop head retaining member including a threaded opening defined therethrough being adapted for threadably engaging said second threaded part of said rod whereas said sleeve of said shank is adapted for threadably engaging said first threaded part of said rod, whereby said mop head is secured to said mop holder by way of said mop head retaining member cooperating with said elongated member.

2. A mop holder as defined in claim 1, wherein said mop head comprises a webbing transversely mounted thereto around a middle section thereof, said opening of said mop head being further defined through said webbing and being adapted with a grommet.

3. A mop holder as defined in claim 2, wherein an upper surface of said elongated member at least partly underlies said webbing of said mop head, said rod extending from said upper surface.

4. A mop holder as defined in claim 3, wherein said elongated member also comprises a number of pointed teeth integral thereto and extending from said upper surface thereof through said webbing into said middle section of said mop head for providing further substantially lateral restraint of said mop head on said elongated member.

5. A mop holder as defined in claim 2, wherein said grommet is made of brass.

6. A mop holder as defined in claim 2, wherein said mop head retaining member is an oversized nut at most as large as said webbing, whereby said mop head is urged against said elongated member by said nut whereas said shank abuts said nut for ensuring tightness thereof.

7. A mop holder as defined in claim 1, wherein said second threaded part of said rod substantially adjoins said first threaded part thereof.

8. A mop holder as defined in claim 1, wherein said shank, said elongated member and said mop head retaining member are made of a plastic material.

9. A mop holder as defined in claim 1, wherein at least one opening is defined in said upper part of said sidewall of said shank for receiving a nail to secure the mop handle to said shank.

* * * * *